United States Patent [19]

Bradley, Jr. et al.

[11] 4,195,645

[45] Apr. 1, 1980

[54] TOBACCO-SUBSTITUTE SMOKING MATERIAL

[75] Inventors: Hubert Bradley, Jr., Matthews, N.C.; Robert G. Bayless, Yellow Springs, Ohio; Ronald L. Hart, Xenia, Ohio; Danny A. Davis, Casstown, Ohio

[73] Assignee: Celanese Corporation, New York, N.Y.

[21] Appl. No.: 885,915

[22] Filed: Mar. 13, 1978

[51] Int. Cl.[2] ..... A24B 3/14; A24D 1/18

[52] U.S. Cl. ..... 131/2; 131/15 C; 131/17 A; 131/140 C; 131/144; 428/403; 428/407; 252/316

[58] Field of Search ..... 131/2, 15 R, 15 C, 17 R, 131/17 A, 144, 140 C; 428/403, 407; 252/316

[56] References Cited

U.S. PATENT DOCUMENTS

| | | | |
|---|---|---|---|
| 3,550,598 | 12/1970 | McGlumphy | 131/10.1 X |
| 3,674,704 | 7/1972 | Bayless et al. | 252/316 |
| 3,683,936 | 8/1972 | O'Niel | 131/10.1 X |
| 3,748,277 | 7/1973 | Wagner | 252/316 |
| 3,812,056 | 5/1974 | de la Torriente | 252/316 |
| 3,816,331 | 6/1974 | Brown et al. | 252/316 |
| 3,877,468 | 4/1975 | Lichtheckert et al. | 131/2 |
| 3,931,824 | 1/1976 | Miano et al. | 131/2 |

*Primary Examiner*—V. Millin

*Attorney, Agent, or Firm*—Andrew F. Sayko, Jr.

[57] ABSTRACT

A tobacco-substitute smoking material is provided which, in the preferred embodiment includes a polysaccharide, such as cellulose or a derivative thereof, as a combustible organic ingredient. A tobacco alkaloidal material, such as nicotine or a derivative thereof, is incorporated into the smoking material in the form of a plurality of combustible microcapsules containing the tobacco alkaloidal material.

36 Claims, No Drawings

TOBACCO-SUBSTITUTE SMOKING MATERIAL

BACKGROUND OF THE INVENTION

This invention relates to tobacco substitutes, in particular to simulated tobacco and to products containing simultated tobacco.

The composition of natural tobacco leaves includes aromatic and resinous substances, alkaloids, sugars, salts, and crude fibers. The aromatic and resinous substances provide the desirable smell and flavor impact associated with tobacco smoking.

The recently expressed concern about the effects of the pyrolysis products emanating from natural tobacco has created a demand for products that may be substituted for tobacco. Optimally, a successful tobacco substitute product should yield smoke which has a substantially lower amount of undesirable components than tobacco smoke, yet provide a flavor impact and combustion rate that is acceptably similar to that of tobacco.

One example of a substitute for tobacco is disclosed in U.S. Pat. No. 3,931,824 to Miano et al. The Miano et al. tobacco substitute is basically made up of combustible organic materials, such as cellulose derivatives, and a non-combustible filler material. Additional flavor impact and odor properties of the Miano et al. tobacco substitute are provided by the inclusion of a wide variety of additives, such as tobacco extracts, fruit extracts, and synthetic flavors. Miano et al. also mentions that nicotine and other alkaloid products may be added in controlled amounts.

It is desirable to include nicotine in tobacco substitutes, such as those disclosed in the Miano et al. patent, in order to increase the similarity of the flavor impact of the substitute product to that of tobacco. However, because tobacco alkaloids such as nicotine are quite volatile when isolated from tobacco, it has been difficult, if not commercially impractical, to produce a tobacco substitute product containing nicotine. For example, in order to handle the tobacco alkaloids in the manufacturing process, safety precautions, such as expensive exhaust and monitoring equipment, may be necessary to ensure that the tobacco alkaloid vapors in the manufacturing plant would remain at a sufficiently low level. In addition to problems encountered in incorporating tobacco alkaloids into tobacco-substitute products, the shelf life of tobacco alkaloid-containing substitute products may not be of sufficient duration for these products to be commercially practical, due to the relatively rapid rate of volatilization of the tobacco alkaloids.

SUMMARY OF THE INVENTION

It has now been found that satisfactory tobacco-substitute smoking materials can be produced by incorporating a plurality of combustible microcapsules containing a tobacco alkaloidal material into the tobacco-substitute smoking materials. Suitable materials for this purpose include those containing a combustible organic ingredient comprising a polysaccharide, such as cellulose, or the like. Because the alkaloidal materials are incorporated into the substitute smoking materials of the present invention in microencapsulated form, and thus are separated from the manufacturing environment, safety problems usually associated with incorporation of tobacco alkaloids directly into tobacco-substitute products are greatly diminished. In addition, the tobacco-substitute products that are products of the present invention have a shelf life which is sufficient for commercial purposes. Thus, the smoking materials produced by this invention provide a tobacco-substitute product which provides a smoke having a flavor impact very nearly approximating that of tobacco, while containing less components of the type which may be undesirable or even harmful to the smoker.

DETAILED DESCRIPTION

Tobacco alkaloid-containing tobacco-substitute materials are produced by incorporating a plurality of combustible microcapsules containing a tobacco alkaloid or a derivative thereof into a tobacco-substitute material. The preferred tobacco substitute material includes a combustible organic ingredient which is preferably a polysaccharide. In addition, a non-combustible inorganic filler material may be present. As used throughout this specification, the term polysaccharide includes polysaccharides, salts, ethers and esters of polysaccharides, modified polysaccharides such as oxidized cellulose, and mixtures of polysaccharides and their salts.

Microcapsules which may be used in the tobacco substitute materials of the present invention have a core material encapsulated by a combustible, polymeric wall material. Microcapsules containing a tobacco alkaloidal material and a method for preparing such microcapsules are disclosed in copending application U.S. Ser. No. 885,914, filed of even date herewith. The disclosure thereof is incorporated herein by reference to the extent pertinent.

The core material of the microcapsules can be a tobacco alkaloidal material such as a tobacco alkaloid, e.g., nicotine, nornicotine or anabasine, or a suitable derivative thereof. The tobacco alkaloidal material may itself constitute the core material, or it may be carried in a vehicle. The vehicle may be aqueous or non-aqueous, and the tobacco alkaloid or its derivative may be in suspension or solution therein.

One especially suitable core material for the present purposes is an aqueous solution of a water-soluble derivative of a tobacco alkaloid. The preferred water-soluble derivative is an addition salt of a tobacco alkaloid with a physiologically acceptable organic or inorganic acid. Preferably, for greater process efficiency some free acid is also present in the aqueous solution. The amount of free acid preferably is at least about 0.1 percent by weight of the stoichiometric amount necessary to form the acid addition salt, more preferably at least about 10 percent by weight.

Especially preferred aqueous core materials for use in microcapsules intended as additives to tobacco substitute smoking materials are aqueous solutions of a tobacco alkaloid acid addition salt of a relatively strong acid having a relatively low equivalent weight. For this purpose, preferred are organic or inorganic acids having at least one pK value of about 5 or less, more preferably having at least one pK value in the range of about 2 to about 4. Illustrative such acids are citric acid ($pK_1=3.08$, $pK_2=4.74$, $pK_3=5.40$), orthophosphoric acid ($pK_1=2.12$, $pK_2=7.21$, $pK_2=12.67$), phosphorous acid ($pK_1=2.00$, $pK_2=6.59$), pyrophosphoric acid ($pK_1=0.85$, $pK_2=1.49$, $pK_3=5.77$, $pK_4=8.22$), malic acid ($pK_1=3.40$, $pK_2=5.11$), d-tartaric acid ($pK_1=2.98$, $pK_2=4.34$), and the like.

In order to prolong the retention of nicotine in the microcapsule, in addition to the nicotine acid addition salt it is preferred to have in the core material an excess of the corresponding acid. In particular, the presence of the corresponding acid in an amount of about 0.1 to about 100 percent by weight in excess of the stoichiometric requirement for formation of the acid addition salt has been found to be especially desirable.

The wall of the microcapsule is a substantially water-impermeable, cross-linked polymeric material which completely surrounds, and thus encapsulates, the core material. The wall must be capable of releasing the alkaloid (e.g., by diffusion, by rupturing or combustion of the microcapsule wall) at the temperatures generated in such tobacco-substitute materials when they are smouldering. A preferred wall material for such use is a cross-linked, previously partially hydrolyzed ethylene-vinyl acetate copolymer.

Microcapsules having a considerable size range are useful in the present invention. Microcapsule size can extend from an average diameter of about one micron and less to above several thousand microns and more. The usual size for the microcapsules is about 1 micron to about 1500 microns in average diameter, and is generally in the range of about 5 microns to about 500 microns. Similarly, the microcapsules can contain varying amounts of core material which can constitute up to about 99 percent or more of the total weight of each microcapsule. Preferably, the core material constitutes about 50 to about 97 percent of the total weight of each microcapsule. The tobacco alkaloid content of the microcapsule can vary and usually constitutes about 10 to about 50 weight percent of the microcapsule. The alkaloid content of the core material itself, of course, is higher than the foregoing values and can range from about 15 to about 75 weight percent.

A preferred process for encapsulating tobacco alkaloids, such as nicotine, anabasine, nornicotine, and the like, includes first forming an aqueous vehicle carrying a tobacco alkaloid. Preferably, this is done by forming a water-soluble derivative of the tobacco alkaloid, such as an acid addition salt thereof, and then dissolving the tobacco alkaloid derivative in water to form an aqueous solution. The tobacco alkaloid-carrying aqueous vehicle is then subjected to a microencapsulation process of the liquid-liquid phase separation type, utilizing an organic liquid vehicle, an aqueous core material, and a partially hydrolyzed ethylene-vinyl acetate copolymer as the wall-forming material. The capsule wall formed by this process is subsequently hardened to produce a relatively water-impermeable, protective wall.

Inasmuch as tobacco alkaloids are nitrogeneous bases, the acid addition salts of a tobacco alkaloid can be prepared by the neutralization of the alkaloid in its free base form with an appropriate amount of an organic or inorganic acid. Examples of such acids include acetic, lactic, salicyclic, glycolic, succinic, tartaric, maleic, malic, palmitic, protocatechuic, citric, ortho-phosphoric, phosphorous, pyrophosphoric, methanesulfonic acids, and the like. The neutralization can be carried out by a variety of procedures known to the art to be generally useful for the preparation of acid addition salts. The choice of the most suitable procedure will depend on a variety of factors including convenience of operation, economic considerations, and particularly the solubility characteristics of the particular free base, the acid, and the acid addition salt. If the acid is soluble in water, the free base can be dissolved in water containing an equivalent amount of the acid, and, if desired, after reaction, the water may be removed by evaporation. In some instances, the salt precipitates from the aqueous solution, particularly when cooled. If the acid is soluble in a relatively non-polar solvent, such as diethyl ether or diisopropyl ether, separate solutions of the acid and free base in such a solvent can be mixed in equivalent amounts, whereupon the acid addition salt will usually precipitate because of its relatively low solubility in the non-polar solvent. Alternatively, the free base can be mixed with an equivalent amount of the acid in the presence of a solvent of moderate polarity, such as a lower alkanol, a lower alkanone, or a lower-alkyl ester of a lower alkanoic acid. Examples of these solvents are ethanol, acetone, and ethyl acetate, respectively. Subsequent admixture of the resulting solution of acid addition salt with a solvent of relatively low polarity, for example, diethyl ether or hexane, will usually cause precipitation of the acid addition salt. The acid addition salts produced in the foregoing manner can then be dissolved in water in an amount necessary to provide the desired tobacco alkaloid content in the microcapsule.

To assure adequate partition of the tobacco alkaloid acid addition salt away from the organic liquid vehicle and for minimal tobacco alkaloid release from the produced microcapsules during subsequent handling and processing into smoking articles, it is preferred that the aqueous, tobacco alkaloid-containing core material that is to be encapsulated contain an excess of the acid used to protonate the tobacco alkaloid. Preferably, for greater process efficiency, the amount of acid should exceed the stoichiometric amount needed for formation of the acid addition salt by at least about 0.1 percent by weight, and more preferably at least about 10 percent by weight.

The concentration of the solutes in the aqueous solution during encapsulation is also important. Preferably the amount of water present should exceed the amount needed for a completely saturated solution by about 20 percent by weight.

The capsule wall material can be any film-forming polymeric material that wets the core material. The capsule wall material preferably is a partially hydrolyzed poly(ethylene-vinyl acetate) copolymer in which some of the vinyl acetate groups are hydrolyzed to form vinyl alcohol groups in order to provide reaction sites for subsequent cross-linking. The degree of hydrolysis for the poly(ethylene-vinyl acetate) wall-forming material can be within the relatively broad range of about 15 percent to about 70 percent. Thus, the partially hydrolyzed copolymers of ethylene and vinyl acetate contain ethylene groups, vinyl acetate groups, and vinyl alcohol groups, and can be represented by the general formula

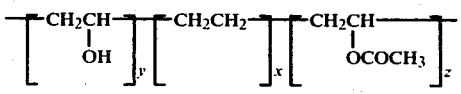

wherein x, y, and z represent mol fractions of ethylene, vinyl alcohol, and vinyl acetate, respectively. With respect to the degree of hydrolysis, the mol ratio of the vinyl alcohol groups to the sum of vinyl alcohol groups and the vinyl acetate groups present is about 0.15 to about 0.7. The amount of ethylene groups present is also important and can be about 60 to about 88 mol percent, or stated in another way, the mol ratio of ethylene groups to the sum of ethylene groups, vinyl alcohol groups and vinyl acetate groups can be about 0.6 to about 0.88. The partially-hydrolyzed poly(ethylene-vinyl acetate) suitable for practicing the present invention preferably has a molecular weight of the order to about 50,000 and a melt index (using a 2160 gram force at 190° C. for 10 minutes) of about 2 to about 100, more preferably a melt index of about 5 to about 50. The molecular weight of the copolymer is not overly critical, except that if the molecular weight is too high the copolymer will be relatively insoluble in the liquid vehicle that forms a major portion of the encapsulation system and if the molecular weight is too low, it may be difficult to induce phase separation during encapsulation. Other suitable polymeric wall materials are the poly(vinyl-formal) polymers, poly(vinyl-butyral) polymers, alkylated celluloses (e.g., ethyl cellulose), acylated celluloses (e.g., cellulose acetate butyrate), and the like.

To cary out an illustrative nicotine citrate microencapsulation process, a solution of a liquid vehicle such as toluene and a wall material comprising partially hydrolyzed ethylene-vinyl acetate copolymer (HEVA), having from about 15 percent to about 70 percent, and preferably from about 30 percent to about 60 percent of its vinyl acetate groups hydrolyzed to form vinyl alcohol groups, is prepared at an elevated dissolution temperature which is suitably above about 70° C. and preferably from about 75° C. to about 90° C. The produced solution is then allowed to cool to a dispersion temperature from about 50° C. to about 65° C. A previously prepared aqueous solution of nicotine citrate, preferably containing an excess of citric acid, is then added to the HEVA-toluene solution with vigorous agitation so as to disperse the aqueous solution as minute droplets of core material within the HEVA-toluene solution.

Next, liquid-liquid phase separation of the HEVA copolymer from the toluene solution thereof is induced by adding a phase separation inducer such as cottonseed oil and then cooling the resulting admixture to a phase-separation temperature in the range from about 15° C. to about 50° C., and preferably from about 20° C. to about 30° C., while continuing the agitation to maintain the dispersed core material droplets in suspension. When phase separation is induced within the system, the wall-forming HEVA copolymer material separates out as another discontinuous phase, i.e., a third phase, that preferentially wets the capsule core material entities and forms a sheath or an embryonic capsule wall. This third phase is a relatively concentrated solution or gel of the polymeric base material, is more viscous than the continuous phase, and in addition, is of sufficiently high viscosity to maintain a substantially continuous sheath around the discrete capsule core material entities in the system despite the shearing forces incident to the forces required to maintain these entities in dispersion.

Next, a solution of a cross-linking agent, such as polyfunctional isocyanates (e.g., toluene diisocyanate [TDI] or TDI adducted with trimethylol propane in toluene), is added to the cooled admixture to cross-link, and thus to harden, the HEVA sheath which is deposited about the core material as a result of the aforesaid addition of the phase-separation inducing cottonseed oil. After the isocyanate addition, the produced admixture is further cooled to a temperature in the range of about 0° C. to about 20° C. and is then permitted to warm to ambient temperature while being continuously agitated. Agitation is continued until cross-linking is completed. Thereafter, the produced microcapsules containing nicotine citrate and free citric acid are recovered, washed, and dried in air, or preferably under vacuum, to a freely flowing consistency and classified as to size. Vacuum drying is preferred because in some instances it is desirable to increase the concentration of the solute or solutes in the aqueous core material. Prolonged drying under vacuum will permit some of the water to diffuse out through the microcapsule wall.

In a similar manner microcapsules containing other tobacco alkaloidal materials, e.g., nicotine ortho-phosphate, nicotine d-tartarate, nicotine malate, with or without an amount of the corresponding acid in free form being present, can be prepared.

Preferred tobacco-substitute smoking materials for the practice of the present invention include smoking materials having a combustible organic ingredient which comprises a polysaccharide selected from the group consisting of cellulose derivatives including oxidized cellulose, their salts, esters and ethers and mixtures thereof, having the recurring anhydroglucose unit:

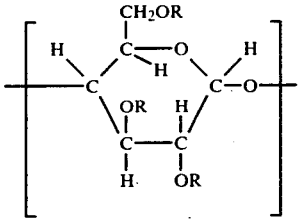

wherein at least one R is selected from the group consisting of lower alkyl, carboxy lower alkyl, hydroxy lower alkyl and mixtures thereof; the remaining Rs are hydrogen, and the average degree of substitution is about 0.2 to about 3.0. The combustible polysaccharide and the particulate inorganic filler are suitably present in a weight ratio of about 15.85 to 85:15.

Processing of the combustible materials into tobacco-substitute smoking materials may be facilitated by cross-linking a portion of the combustible materials by the reaction of a cross-linking agent with the residual hydroxyl groups of the combustible materials. Suitably, the cross-linking agent may be added in an amount up to about 5 percent by weight, and preferably from about 0.001 percent to about 0.5 percent by weight based on the total weight of the composition. Cross-linking agents which may be used include dimethylol urea-formaldehyde resin, melamine-formaldehyde resins, Kymeme 557®—a polyamide epichlorohydin manufactured by Hercules, Inc. of Wilmington, Delaware, glyoxal, dialdehyde starch, and organic salts or halides having a divalent or trivalent ion such as iron or aluminum.

Both cross-linked, combustion materials and combustible materials which have not been cross-linked may interact with metallic ions present in substances such as tobacco pectins or conventional tobacco additives such as humectants, and reconstituted materials which may be incorporated therein. Thus, the finished form of the combustible material may exist in a number of modified states, depending upon the degree of cross-linking which has been induced, and the degree of interaction with components of other materials.

A filler material may advantageously be employed in the present compositions. Suitable fillers for this purpose include non-toxic particulate materials which preferably have average minimum dimensions of from about 0.2 microns to about 1 millimeter. Even more preferably, the filler particles have average minimum dimensions of about 0.05 millimeters and larger. It is also preferred that the particulate filler materials have a maximum dimension of about 0.25 mm, and more preferably, about 0.10 mm. Suitable materials may be selected from inorganic compounds and the elements, so long as the material selected is non-toxic, i.e., pharmacologically inactive, in the sense of significant adverse effects in a causative relationship upon oral ingestion of the substance itself or its combustion products. However, a reduced delivery of undesirable components upon smoking is more readily observed when the particulate material comprises an inorganic compound, an element or a mixture thereof.

Inorganic compounds which may be used as fillers may be comprised of a cation selected from Column (A) and an anion selected from Column (B).

| (A) | | | (B) |
|---|---|---|---|
| Lithium | Manganese | Silicon | Oxides |
| Sodium | Aluminum | Titanium | Hydrated Oxides |
| Potassium | Iron | Tin | Hydroxides |
| Barium | | Zinc | Carbonates |
| Magnesium | | Molybdenum | Phosphates |
| Calcium | | | Aluminates |
| | | | Stannates |
| | | | Carbides |
| | | | Silicates |

Preferably, the cations employed are selected from the group consisting of zinc, titanium, magnesium, calcium, aluminum, and iron. Desirably, these cations are in the form of the carbonates, oxides, hydroxides, sulfates, phosphates, aluminates, silicates and aluminosilicates. The oxides, carbonates and hydroxides are particularly desirable since these anions decompose to carbon, hydrogen and oxygen upon combustion. Inorganic compounds in their naturally occurring states, such as dolomite, diatomaceous earth, perlite, magnesite, vermiculite, etc. are also suitable.

As previously noted, elements may also be used as filler materials. The preferred element is carbon.

While the filler materials are generally granular in nature, they may also be in fibrous form. Materials readily usable in fibrous form include metal oxide and metal carbide whiskers. Preferably the fibrous materials will have an average length of from about 0.1 mm. to about 5 mm., and an average minimum dimension of the magnitude previously noted.

In order to obtain a smouldering rate comparable to tobacco, the combustible polysaccharide and filler are generally combined in a weight ratio of from about 15:85 to about 85:15, and preferably, in a ratio of about 15:85 to about 75:25 and most preferably in a ratio of about 15:85 to about 50:50. Combination of these materials and these ratios generally yields a material having a smouldering rate comparable to tobacco when smoked under analogous conditions; that is, about 3–10 mm/minute in conventional cigarette form. A smouldering rate of this magnitude corresponds to a puff count of about 4–10 in a cigarette smoked on a 60 second cycle. It is to be expected, however, that specific compositions will have different combustion rates.

Combinations of particulate fillers may also be employed in order to obtain the ultimate smouldering rate desired. Inorganic fillers found to be particularly suitable in controlling smouldering rates include titanium dioxide, magnesium oxide, silica gel, sodium silicate, sodium aluminate, zinc oxide, aluminum oxide, ferric oxide, calcium aluminate, silica aluminate, calcium carbonate, perlite, diatomaceous earth, dolomite, carbon, magnesite, zeolite, vermiculite, and mixtures thereof.

The compositions of the present invention are suitable in the form of an intimately mixed state, in the form of a film, or in some physical state between these two extremes. It is preferred from the standpoint of processing and convenience of smoking that the compositions be in shredded film form when the smokable product consists of solely the present smoking material. When the present compositions are blended with tobacco, or with a suitable support medium as later defined, however, mixtures are equally preferred. As an example of the above intermediate state of the composition, it is possible to use the defined combustible material as a bonding agent and bond the filler particles to the surfaces of the tobacco or other support medium.

Films are generally prepared by adding all of the desired ingredients, including the tobacco alkaloid-containing microcapsules, to water, intimately mixing the materials and casting the mixture onto a suitable surface. The mixture at the time of casting will ordinarily contain about 65 to about 95% water. Percentages of water outside of this range are possible, but increased processing difficulties result. Generally, the film will be cast to a dried thickness of from about 2 to about 20 mils, preferably from about 3 to about 10 mils, and even more preferably to about 5 mils. Such films are generally cut to a width of about 16–60 cuts per inch prior to use. Instead of water, organic solvents such as alcohols may also be used in some instances as long as these solvents do not adversely affect the microcapsules and are suitable to dissolve the polysaccharides.

When the present material is in film form, desirable products can also be produced by uniformly incorporating into the film minor amounts of a second combustible material. Such materials include tobacco dust, stalks and stems; sodium gluconate; pectins; natural gums, e.g., guar gum; cellulose and oxidized cellulose. To preserve film integrity and maintain filling power of the film, this optional second combustible material may be used in an amount of from zero to 40% of the total product with up to 30% being preferred.

Combinations of the present materials within the specified ratios will generally produce a smoking material yielding an ash comparable to that of tobacco. If desired, however, the type of ash formation and appearance thereof can be readily modified by the addition of various substances as degraded cellulose, carbon and non-toxic hydrated metal salts generally.

From an aesthetic standpoint, addition of various coloring agents to the smoking material may be desirable. For example, one may obtain a material having a color similar to natural tobacco by the addition of materials such as carbon, iron oxide, food dyes, tobacco extracts, organic colorants such as caramel, and inorganic pigments or mixtures thereof to the basic smoking materials. Of course, contrary to natural tobacco, one may make the present material any color desired. Generally up to about 5.0 weight percent of coloring agent, based on the total weight of the composition can be employed. Preferably, about 0.1 to about 2.0 weight percent of coloring agent is utilized.

When the present compositions are prepared in film form, incorporation of a plasticizer into the film in order to increase the flexibility thereof is often desirable. Plasticizers which have been found to be suitable for this purpose include water, butylene glycol, glycerol, and propylene glycol. From about 1 to about 30 weight percent and preferably from about 2 to about 25 weight percent of plasticizer, based on the total weight of the composition is ordinarily used.

Film formation may also be improved by adding a wetting agent such as Tween 20®, a polyoxyethylene (20) sorbitan monolaurate manufactured by Atlas Chemical Industries, Inc.; Tergitol, TMN®, a polyglycol ether of trimethyl nonanol manufactured by Union Carbide; or Germ-i-tol®, an alkyl dimethyl ($C_{12}$–$C_{1x}$) benzyl ammonium chloride manufactured by Fine Organics, Inc.; to the composition prior to preparation of the film. Preferably, about 0.05 to about 1.0 weight percent of wetting agent is employed, with up to 10 weight percent being suitable.

The tobacco alkaloid-containing microcapsules may be incorporated into the above-described tobacco substitute materials in a number of different ways to provide the desired alkaloid content in the final product. One suitable method is to incorporate the microcapsules into the above-described film of the tobacco substitute materials during manufacture as mentioned hereinabove. Although some of the microcapsules may be ruptured when the film is subsequently shredded, the resulting loss of microcapsules is well within reasonable limits.

In another method, the microcapsules may be admixed with previously shredded material. To do this, it is advantageous to treat the surfaces of the microcapsules in order to make them more adherent to the shredded smoking materials. As an example, the microcapsules may first be suspended in a liquid vehicle, such as water, or a binder emulsion and subsequently contacted with the shredded smoking material. The surface liquid retained on the microcapsules will aid in holding the microcapsules to the surfaces of the smoking material.

The following examples are illustrative of the present invention. In these examples all amounts are given as parts by weight unless otherwise indicated.

EXAMPLE I

One hundred forty parts deionized water at room temperature was transferred to a high shear blender with 3.70 parts glycerin and 2.25 parts caramel coloring. Then 14 parts of low molecular weight, 0.78 D.S., sodium carboxymethyl cellulose (CMC) was slowly added to the vortex of the vigorously agitated water. After the CMC was completely dissolved (5–10 min.), 28 parts limestone, 24 parts perlite, 0.08 parts activated carbon, and 1.0 parts urea were added. After the mixture was completely dispersed, 2.152 parts of microencapsulated nicotine citrate capsules (size not exceeding about 170 microns; about 20 wt.-% nicotine) were added and mixing was continued until the capsules were completely dispersed. A film was then cast on a Teflon® coated fabric at 15 mils and dried in a circulating air oven at 125° C. After drying and conditioning (75° F./60% RH), the film is ready for shredding. The film was shredded to an average width of 0.9 mm and an average length of 1.0 cm. Shredded films were formed into cigarettes of 25 mm in circumference and 85 mm in length by wrapping in cigarette paper on a hand roller. Twenty millimeters were cut from each cigarette and a 20 mm cellulose acetate cigarette filler was attached.

Cigarettes thus prepared were smoked on an apparatus which took 35 ml puffs over a two second interval on a 60 second cycle. The cigarettes were smoked to a 30 mm butt. Tar weight was determined by drawing the smoke from the cigarette through a Cambridge filter pad, which removed at least 99% of the solid particulate matter, and weighing the pad before and after smoking. The nicotine in the particulate matter was extracted from the Cambridge pad with isopropyl alcohol. An aliquot of the extract was steam distilled and a UV absorbance curve of the distillate was obtained with a scanning UV-visible spectrophotometer. The nicotine concentration was calculated from the maximum absorbance at approximately 259 nm using external standards.

EXAMPLE II

Cigarettes were prepared in the same manner as in Example I except that 4.24 parts of microencapsulated nicotine citrate capsules (20.0% nicotine) were added.

EXAMPLE III

Cigarettes were prepared in the same manner as in Example I except that 1.722 parts of microencapsulated nicotine citrate capsules (27.0 wt.-% nicotine) and 2.4 parts caramel coloring were added. These were 85 mm unfiltered cigarettes.

TABLE I

| | Example I | Example II | Example III | Control |
|---|---|---|---|---|
| Shred % nicotine | 0.59 | 1.3 | 0.60 | |
| Cigarette wt., gm. | 1.22 | 1.20 | 1.20 | 1.19 |
| Puff Count | 6.3 | 6.3 | 6.1 | 6.0 |
| CPM[1], mg/cig | 5.4 | 6.9 | 8.0 | 5.9 |
| Nicotine delivered, mg/cig | 0.19 | 0.53 | 0.40 | |

[1]Cambridge Particulate Matter, a measure of the total amount tar, nicotine and water delivered in the smoke.

We claim:

1. A smoking material comprising a polysaccharide as a combustible organic ingredient and a plurality of combustible microcapsules including a capsule core material which is a water-soluble derivative of a tobacco alkaloidal material, which derivative is an addition salt of the tobacco alkaloid with a physiologically acceptable acid wherein said capsule core material also includes an amount of the same acid in free form as is present in the acid addition salt, the core material being encapsulated in a sheath of a combustible, film-forming, water-impermeable, polymeric wall material.

2. A smoking material in accordance with claim 1 further including a particulate inorganic filler.

3. A smoking material in accordance with claim 1 further including a particulate inorganic filler, and wherein the major proportion of the combustible organic ingredient is a material selected from the group consisting of cellulose derivatives, their salts and mixtures thereof, having the recurring anhydroglucose unit:

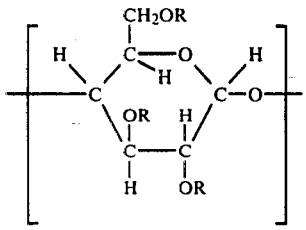

wherein at least one R is selected from the group consisting of lower alkyl, carboxy lower alkyl, hydroxy lower alkyl and mixtures thereof; the remaining Rs are hydrogen, and the average degree of substitution is about 0.2 to about 3.0; said major proportion of said combustible organic ingredient and said particulate inorganic filler being present in a weight ratio of about 15:85 to 85:15.

4. A smoking material comprising a polysaccharide as a combustible organic ingredient and a plurality of combustible microcapsules containing a tobacco alkaloidal material associated therewith, wherein each of the plurality of microcapsules comprises a capsule core material which includes an aqueous solution of a water-soluble addition salt of a tobacco alkaloid with a physiologically acceptable acid wherein said capsule core material also includes an amount of the same acid in free form as is present in the acid addition salt, surrounded by a sheath of cross-linked, previously partially hydrolyzed ethylene-vinyl acetate copolymer.

5. A smoking material in accordance with claim 4 wherein the ethylene-vinyl acetate copolymer contains from about 60 to about 88 mol percent of ethylene.

6. The smoking material in accordance with claim 4 wherein the tobacco alkaloid is nicotine.

7. The smoking material in accordance with claim 4 wherein the tobacco alkaloid is anabasine.

8. The smoking material in accordance with claim 4 wherein the tobacco alkaloid is nornicotine.

9. A smoking material including a combustible organic material, a particulate inorganic filler, and a plurality of combustible, tobacco alkaloid-containing microcapsules; the major proportion of the combustible organic ingredient being a material selected from the group consisting of film-forming cellulose derivatives, their salts, and mixtures thereof, having the recurring anhydroglucose unit:

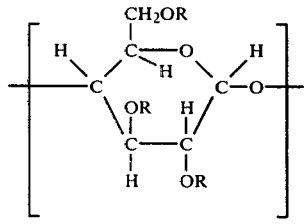

wherein at least one R is selected from the group consisting of lower alkyl, carboxy lower alkyl, hydroxy lower alkyl groups and mixtures thereof, remaining Rs are hydrogen, and the average degree of substitution is about 0.2 to about 3.0, said major proportion of said combustible organic ingredient and said particulate inorganic filler being present in a weight ratio of about 15:85 to about 75:25; each of the plurality of microcapsules including a capsule core material which is a water-soluble derivative of a tobacco alkaloidal material, which derivative is an addition salt of the tobacco alkaloid with a physiologically acceptable acid, wherein said capsule core material also includes an amount of the same acid in free form as is present in the acid addition salt, the core material being encapsulated in a sheath of cross-llinked, previously partially hydrolyzed ethylene-vinyl acetate copolymer.

10. The smoking material in accordance with claim 9 wherein the capsule core material is an aqueous solution of a water-soluble derivative of a tobacco alkaloid.

11. The smoking material in accordance with claim 9 wherein the tobacco alkaloid is nicotine.

12. The smoking material in accordance with claim 9 wherein the tobacco alkaloid is anabasine.

13. The smoking material in accordance with claim 9 wherein the tobacco alkaloid is nornicotine.

14. The smoking material in accordance with claim 9 wherein said particulate inorganic filler is selected from the group consisting of titanium dioxide, magnesium oxide, silica gel, sodium silicate, sodium aluminate, zinc oxide, aluminum oxide, ferric oxide, calcium aluminate, silica aluminate, calcium carbonate, diatomaceous earth, dolomite, carbon, perlite, magnesite, zeolite, vermiculite, and mixtures thereof.

15. The smoking material in accordance with claim 9 wherein said major proportion of said combustible organic ingredient is carboxymethyl cellulose.

16. The smoking material in accordance with claim 9 wherein said major proportion of said combustible organic ingredient is a carboxymethyl cellulose salt.

17. The smoking material in accordance with claim 9 wherein said major proportion of said combustible organic ingredient is a mixture of carboxymethyl cellulose and carboxymethyl cellulose salts.

18. The smoking material in accordance with claim 9 wherein said particulate inorganic filler comprises perlite.

19. The smoking material in accordance with claim 9 wherein said particulate inorganic filler comprises limestone.

20. The smoking material in accordance with claim 9 wherein said major proportion of said combustible organic ingredient is sodium carboxymethyl cellulose.

21. The smoking material in accordance with claim 9 wherein said amount of the acid in free form is at least about 0.1 percent by weight of the stoichiometric amount required to form the acid addition salt.

22. The smoking material in accordance with claim 9 wherein said amount of the acid in free form is about 10 percent by weight of the stoichiometric amount required to form the acid addition salt.

23. The smoking material in accordance with claim 9 wherein said acid addition salt is nicotine citrate.

24. The smoking material in accordance with claim 23 wherein free citric acid is also present.

25. The smoking material in accordance with claim 23 wherein free citric acid is present in aqueous solution.

26. The smoking material in accordance with claim 9 wherein said acid addition salt is nicotine ortho-phosphate.

27. The smoking material in accordance with claim 26 wherein free ortho-phosphoric acid is also present.

28. The smoking material in accordance with claim 26 wherein free ortho-phosphoric acid is present in aqueous solution.

29. The smoking material in accordance with claim 9 wherein said acid addition salt is nicotine d-tartarate.

30. The smoking material in accordance with claim 29 wherein free d-tartaric acid is also present.

31. The smoking material in accordance with claim 29 wherein free d-tartaric acid is present in aqueous solution.

32. The smoking material in accordance with claim 9 wherein said acid addition salt is nicotine malate.

33. The smoking material in accordance with claim 32 wherein free malic acid is also present.

34. The smoking material in accordance with claim 32 wherein free malic acid is present in aqueous solution.

35. The smoking material in accordance with claim 9 wherein the ethylene-vinyl acetate copolymer contains from about 60 to about 88 mol percent of ethylene.

36. A smoking material including a combustible organic material, a particulate inorganic filler, and a plurality of combustible, tobacco alkaloid-containing microcapsules; the major proportion of the combustible organic ingredient being a material selected from the group consisting of film-forming cellulose derivatives, their salts, and mixtures thereof, having the recurring anhydroglucose unit:

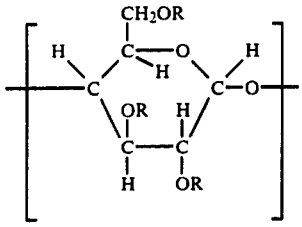

wherein at least one R is selected from the group consisting of lower alkyl, carboxy lower alkyl, hydroxy lower alkyl groups and mixtures thereof, remaining Rs are hydrogen, and the average degree of substitution is about 0.2 to about 3.0, said major proportion of said combustible organic ingredient and said particulate inorganic filler being present in a weight ratio of about 15:85 to about 75:25; each of the plurality of microcapsules including a capsule core material which is a water-soluble derivative of a tobacco alkaloidal material, which derivative is an addition salt of the tobacco alkaloid with a physiologically acceptable acid, wherein said capsule core material also includes an amount of the same acid in free form as is present in the acid addition salt, a core material being encapsulated in a sheath of a combustible, film-forming, water-impermeable, polymeric wall material.

* * * * *